US005187888A

United States Patent [19]

O'Brien et al.

[11] Patent Number: 5,187,888

[45] Date of Patent: Feb. 23, 1993

[54] INDEX TABS FOR HANGING FILE FOLDERS HAVING PRESSURE SENSITIVE ADHESIVE AND LUGS FOR INSERTION IN FOLDER SLOTS

[75] Inventors: Karen M. O'Brien, Bellingham; Lee A. Carlson, Southboro, both of Mass.

[73] Assignee: Dennison Manufacturing Company, Pasadena, Calif.

[21] Appl. No.: 566,848

[22] Filed: Aug. 14, 1990

Related U.S. Application Data

[63] Continuation of Ser. No. 317,255, Feb. 28, 1989, abandoned.

[51] Int. Cl.[5] ..... B42F 21/00

[52] U.S. Cl. ..... 40/359; 40/638

[58] Field of Search ..... 40/359, 360, 299, 641, 40/638; 283/101

[56] References Cited

U.S. PATENT DOCUMENTS

| | | | |
|---|---|---|---|
| 1,317,265 | 9/1919 | Bushnell | 40/359 |
| 1,868,188 | 7/1932 | Barker | 40/360 |
| 4,053,057 | 10/1977 | Snowden | 40/359 X |
| 4,446,183 | 5/1984 | Savagian | 40/299 |

FOREIGN PATENT DOCUMENTS

| | | | |
|---|---|---|---|
| 25341 | 10/1930 | Australia | 40/638 |
| 82010 | 2/1957 | Denmark | 40/360 |

OTHER PUBLICATIONS

Miller's Office Products Catalog, 1987, p. 405.

*Primary Examiner*—Kenneth J. Dorner
*Assistant Examiner*—James M. Gardner
*Attorney, Agent, or Firm*—Arthur B. Moore

[57] ABSTRACT

An index tab and assemblages thereof to be used in conjunction with hanging file folders and the like, in lieu of individual plastic tab holder and paper insert combinations of the prior art. In the preferred embodiment, a plurality of paper or plastic tabs, backed by pressure-sensitive adhesive, are carried on a release sheet, comprising tab stock. Each such tab includes opposing bilaterally symmetric portions. The shape of each half of such tabs may be generally similar to the clear individual plastic tabs holders of the prior art, including a message portion and a base portion. A message is places on the message portion of either, or both halves of a tab. The tab is then peeled from the release paper and the two adhesive-backed opposing halves folded together. In this configuration the base portion may be inserted into the tab slots of a file folder. In lieu of mounting adhesive-backed tabs to a release sheet, the tabs may be interconnected by lands, or may be defined by score lines or perforations. In these variations, the adhesive may be omitted, and a single tab may be provided rather than bilaterally symmetric tabs wherein messages are inscribed on opposite faces of the tab before severing from the tab stock.

8 Claims, 4 Drawing Sheets

INDEX TABS FOR HANGING FILE FOLDERS HAVING PRESSURE SENSITIVE ADHESIVE AND LUGS FOR INSERTION IN FOLDER SLOTS

This is a continuation of co-pending application Ser. No. 317,255 filed on Feb. 28, 1989.

This invention relates to an index tab for hanging file folder systems and the like, and to devices for storing, preparing and dispensing index tabs.

One type of widely-used index tab and hanging file folder system disclosed, for example, in U.S. Pat. No. 4,053,051, has a file folder with a slotted edge to accept slot-in index tabs. The index tabs are typically constructed of flexible clear plastic, comprising a folded structure. The structure includes a parallel message holder portion, in which a paper message-carrying insert may be placed, and a base portion, which has two lug portions for mounting the tab on the slotted file-folder.

The advantages of this type of user-indexed file folder are well known, but the process by which the user creates an index tab is cumbersome. The user must essentially complete a four-step process; particularly, first preparing the paper inserts with a message, next cutting or tearing the paper inserts from each other, then folding the inserts, and finally, inserting the inserts into a plastic index tab.

The preparation of the paper message inserts of the prior art is particularly difficult because the small size of the inserts—even when they are in a continuous perforated strip—makes them susceptible to misalignment and jamming in standard typewriters. Similarly, the preparation of handwritten messages on these inserts is awkward because of their small size.

Moreover, in ordinary use, these paper message insert tabs have a tendency to become dislodged and lost, resulting in further inconvenience to the user.

SUMMARY OF THE INVENTION

Accordingly, it is a principal object of the invention to provide an improved index tab of the type used for hanging file folders. It is desired to simplify and expedite the processes of inscribing information on the tabs and forming the inscribed tabs into a configuration to be appended to the hanging file folder.

Another object is to reduce the likelihood that a tab will be inadvertently removed from a hanging file folder.

In achieving the above and additional objects, the invention provides a one-piece tab for hanging file folders which is severed or removed from tab stock or a tab carrier member after inscribing with a message. Preferably, the tab comprises opposing, bilaterally symmetric portions generally similar in shape to the plastic tab holders of the prior art.

In the preferred embodiment, a plurality of paper or plastic tabs backed by pressure sensitive adhesive are carried on a release sheet, advantegously in a continuous array. The adhesive may be of a single-use type, for use with file folders and permanent indexing of notebooks and the like, or, alternatively, the adhesive may be of the repositionable type, for use in temporary placemarking applications. The tab outer edges are perforated or scored for separation from the remainder of the stock at the time of use, and the bilaterally symmetric tab may be scored or creased along a medial line (line of symmetry), for easy folding at the time of use.

In an alternative embodiment of the invention, a plurality of tabs are joined together in a continuous tab stock, with no carrier sheet. The tabs may be interconnected by lands with no surrounding material, or alternatively may be defined within a surrounding skeleton by perforations or score lines. In this embodiment, no backing adhesive is required.

The index tab stock may be inserted in a typewriter for precise alignment during message placement. Alternatively, a carrier sheet or tab stock skeleton may be perforated along its edges for continuous tractor-feeding on a printing device, providing for the automated preparation of index tabs.

The advantages of the index tab of the present invention include reduced preparation time, multiplicity of application, adaptability to automated user message placement, and reliable performance during use.

Other advantages of the present invention will be apparent in the drawings which follow, and in the description and claims contained herewith, which by way of illustration, show a preferred embodiment of the present invention and the principles thereof. Other embodiments of the invention employing equivalent principles may be made by those skilled in the art without departing from the present invention and purview of the appended claims.

BRIEF DESCRIPTION OF THE DRAWINGS

The above and additional aspects of the invention are illustrated with reference to the detailed description which follows, conjunction with the drawings in which.

DESCRIPTION OF THE PREFERRED EMBODIMENT

Figure 1:
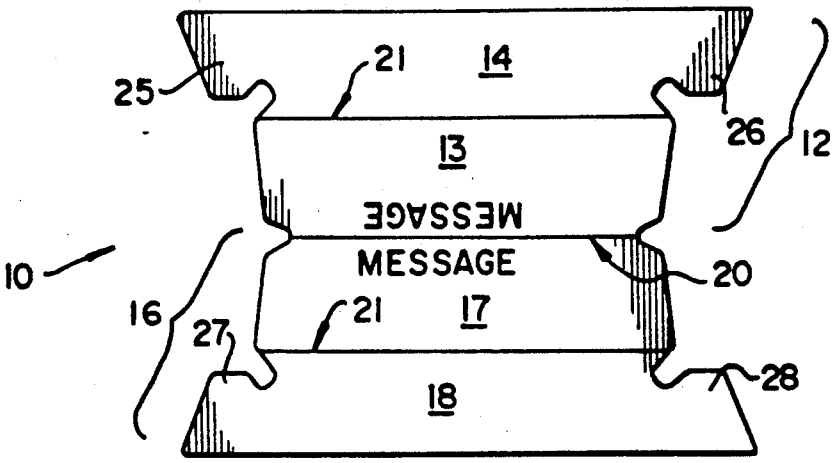
FIG. 1 is a plan view of an index tab for use with a file folder or the like, in accordance with the preferred embodiment.
Figure 2:
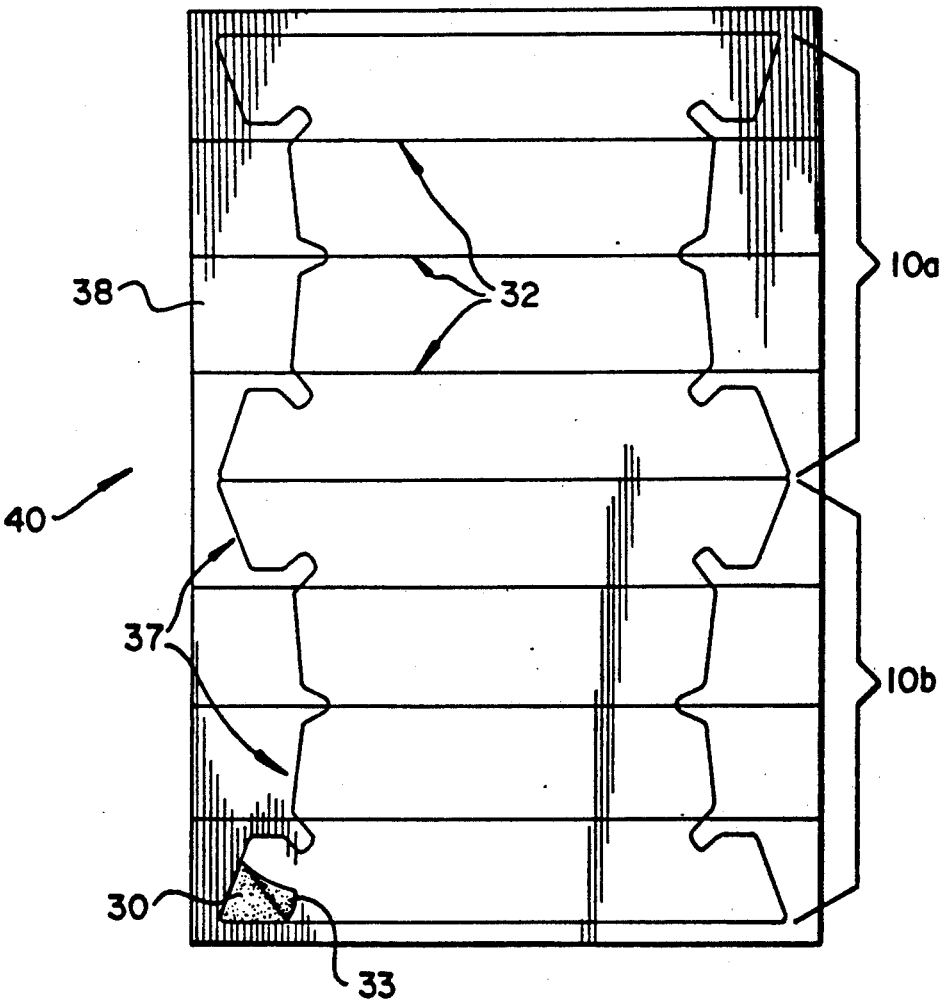
FIG. 2 is a plain view of a carrier sheet for two of the index FIG. 1.

Reference should now be had to FIGS. 1 and 2 which illustrate an improved tab for hanging file folders, and tab stock, in accordance with a first embodiment of the invention. As seen in the plain view of FIG. 1, index tab 10 includes opposing, bilaterally symmetric portions 12 and 16 separated by a center fold line 20. Portion 12 is comprised of a message section 13 and base portion 14, while portion 16 includes message section 17 and base portion 18. (The respective base and message portions are shown separated by fold lines 21 but this is optional). Advantageously, each portion of tab 10 is generally similar in shape to the plastic tab holders for hanging file folders the prior art, and the base portions include lugs 25–28 for engagement by file folder slots as discussed below.

In a first embodiment of the invention, illustrated in FIG. 2, two tabs 10 are mounted on a release sheet 30 to create a tab stock 40. Tabs 10*a* and 10*b* are formed in a cover sheet 35 the back of which is coated with pressure sensitive adhesive and adhered to release sheet 30, as seen at 33 at the longer left corner where a portion of tab 10*b* is removed. Tabs 10*a* and 10*b* are die cut within a surrounding portion 38 or skeleton of the cover sheet 35 along border line 37, while a series of score lines 32 facilitate folding of the tabs after removal. Advantageously, tabs 10 are formed of a plastic film or of paper or other appropriate sheet material. Desirably a double layer of such material provides a durable tab, yet the tab may be easily peeled off the backing sheet.

The pressure sensitive adhesive 33 may be of a single-use type, for permanent forming as a file folder tab or for one-time attachment of the tab to a page or divider, or the adhesive may be of a multiple-use type, for repositioning the tabs when used in semi-permanent index or placemarking applications.

Figure 3:
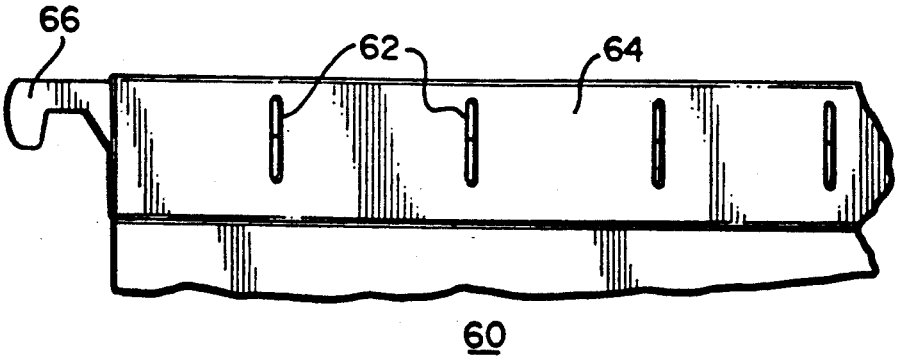
FIG. 3 is a partial perspective view of a prior art file folder bar, with vertical mounting slots for the index tab 1.
Figure 4:
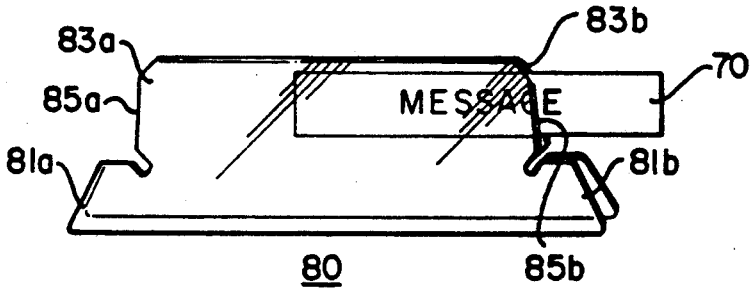
FIG. 4 is a perspective view of a prior art index tab, with a paper message insert partially removed.

The creation of file folder index tabs by the user will now be described for both the prior art and the present invention. FIG. 3 shows a file folder 60, with vertical slots 62 which are equally spaced along the outer edge 64 of the file folder suspension bar 66. Refering to the prior art index tab as depicted in FIG. 4, the tab consists of a plastic index tab holder 80 which includes lugs 81*a* and 81*b* for insertion into file folder vertical slots 62, and transparent opposing walls 83*a* and 83*b*, accessible via openings 85*a* and 85*b*. A paper message insert 70 is inserted into the plastic index tab holder through either of the openings 85*a* or 85*b*.

Preparation of the prior art index tab requires the user to first place a message on the paper message insert 70. Due to the relatively small size of the paper message insert used with the prior art, it is difficult to type messages on the insert. Likewise, handwritten messages are awkward because of the small size of the insert. Although inserts are available in perforated strip stock, the narrow width nevertheless presents difficulties in both typing or writing messages. After a message is placed on the insert, the insert must be separated from the stock, folded and then pushed into one of the ends of the plastic tab holder. Such tab inserts 70 are occasionally lost due to inadvertent removal from the plastic tab holder 80.

Figure 5:
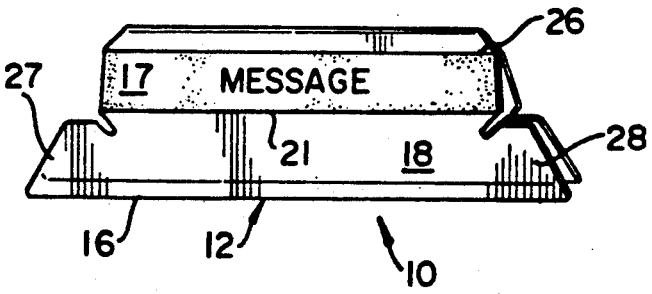
FIG. 5 is a perspective view of the index tab of FIG. 1, prepared for use.

Preparation of the present index tab for use with file folders involves placement of a message on one or both message sections 13 and 17 of a given tab 10 in the tab stock 40, peeling away of the tab from the release paper 30, and folding of the tab along the medial line 20 to cause the tab portions 12 and 16, to adhere to each other. This results in an inscribed tab (FIG. 5) which may be similar in shape to the tab holder 80 of FIG. 4. The tab 10 may be preprinted with a colored zone 26 for color coding purposes. The message portions 17 of the resulting tab may be folded relative to the base portion 18 along fold line 21 to create a desired orientation of such message portion in a file folder.

The placement of a message on the index tab of the present invention is relatively easy because the message portion is an integral part of the tab, which is attached to the release paper. Accordingly, the tab stock may be placed in a typewriter, or may be easily held for handwritten messages. Perforations may be placed on the release paper for use with tractor feed devices, when required.

With both the prior art tab and the present invention, the prepared index tab is then sprung into vertical slots 62 of the file folder 60. The tab lugs are held flat against the suspension bar by the material of the file folder which is wrapped around the suspension bar.

Figure 6:
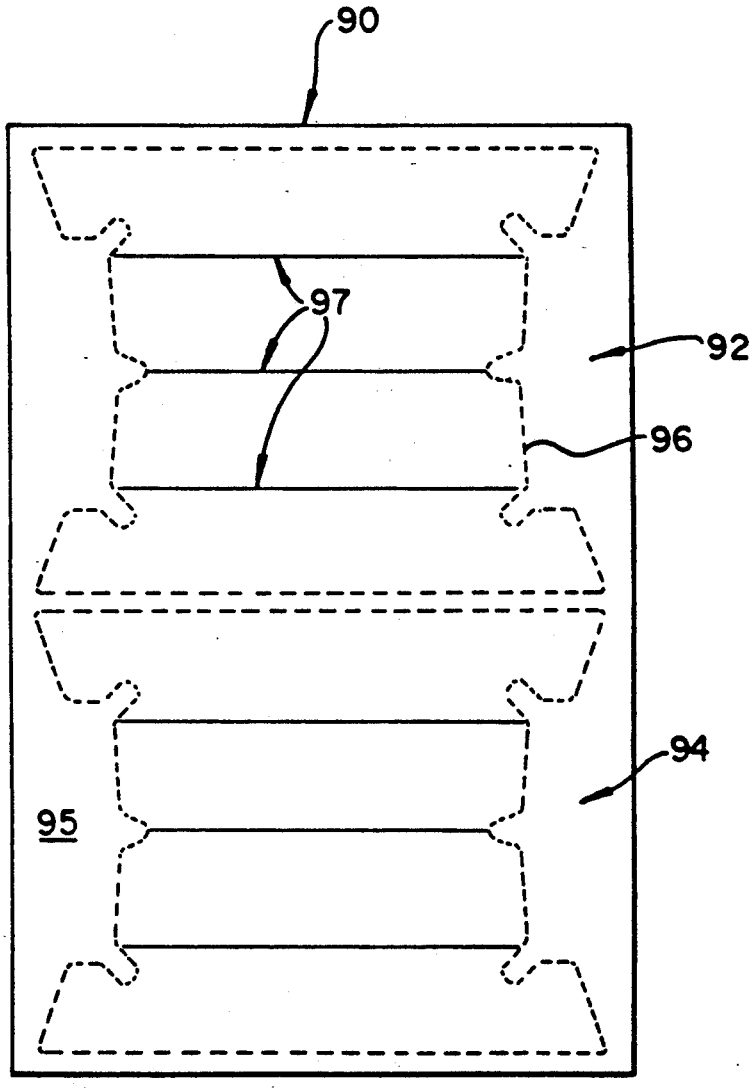
FIG. 6 is a plan view of a perforated tab stock, in accordance with an alternative embodiment of the invention.

FIG. 6 illustrates an alternative form of tab stock 90, which comprises a strip of stiff paper which is perforated to define two tabs 92, 94 within a skeleton 95. These tabs may be removed after inscribing a desired message by separation along their perforated borders 96. In a variation of the embodiment the tab stock 90 may be scored at 97 to facilitate folding as described above. In the embodiment of FIG. 6, it is optional to provide a backing adhesive.

Figure 7:
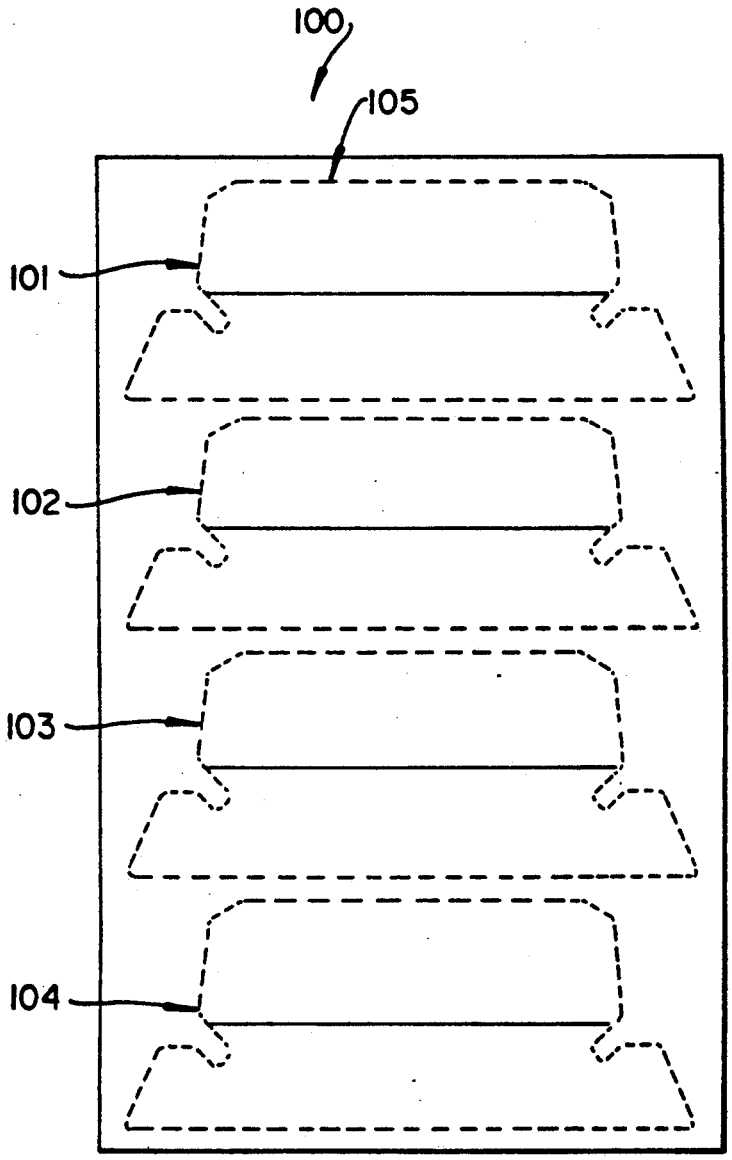
FIG. 7 is a plan view of a perforated tab stock in accordance with a further embodiment of the invention.

In a further variation, shown in FIG. 7, tab stock 100 includes four tabs 101–104 defined by perforated borders 105, wherein each tab corresponds to one of the two tab portions 12, 16 of the tab 10 of FIG. 1. In this embodiment, to inscribe messages on both sides of a tab it is necessary to turn over the tab stock 100. It is desirable to provide a sturdy tab stock material because the final tab comprises a single rather than a double layer.

It can be seen that the present invention provides a considerably more straightforward means for creating and using index tabs. Moreover, the same tabs may be also used with pages or dividers by folding the tab portions over each side of the page or divider. A further advantage of the present invention over the prior art is the stability of the message on the tab: there is no chance of the message becoming disloged, as with the paper inserts used in the prior art plastic holder/paper insert combinations.

While various aspects of the invention have been set forth by the drawings and the specification, it is to be understood that the foregoing description is for illustration only and that various changes in parts, as well as the substitution of equivalent constituents for those shown and described, may be made without departing from the spirit and scope of the invention as set forth in the appended claims.

We claim:

1. An index tab stock, for supplying an index tab for labelling a hanging file folder having a series of spaced slots for holding in place an inserted tab projecting upwardly from the folder, said index tab stock comprising a release sheet; and at least one tab comprising a foldable sheet material in two portions separated by a fold line, each portion including a message section proximate the fold line, said message section's exposed face accepting directly imprinted indicia, and a base section including opposing lugs configured to engage slots of the hanging file folder; said tab being removably adhered to said release sheet by pressure sensitive adhesive;

wherein in use said tab is removed from the release sheet; the tab is folded along said fold lines; said portions are adhered to each other with the opposing lugs aligned; and said lugs are inserted into two slots of said hanging file folder.

2. An index tab stock as defined in claim 1 wherein the tab portions are bilaterally symmetric and the fold line is the axis of symmetry of the tab.

3. An index tab stock as defined in claim 1 wherein the tabs are continuously arrayed on the release sheet.

4. An index tab stock as defined in claim 1 wherein the tabs are surrounded by a border material, and are defined by score lines or perforations.

5. An index tab stock as defined in class 1 wherein the pressure sensitive adhesive is permanent.

6. An index tab stock as defined in claim 1 wherein the pressure sensitive adhesive is reusable.

7. An index tab as defined in claim 1 wherein the foldable sheet material is selected from the group consisting of durable papers and durable plastic films.

8. An index tab stock, for supplying an index tab for labelling a hanging file folder having a series of spaced slots for holding in place an inserted tab projecting upwardly from the folder, said index tab stock comprising a release sheet; and at least one tab formed of a durable, foldable paper or plastic film, comprising two portions separated by a fold line, each portion including a message section proximate the fold line, said message section's exposed face accepting directly imprinted indicia, and a base section including opposing lugs configured to engage slots of the hanging file folder; said tab being removably adhered to said release sheet by pressure sensitive adhesive;

wherein in use said tab is removed from the release sheet; the tab is folded along said fold lines; said portions are adhered to each other with the opposing lugs aligned; and said lugs are inserted into two slots of said hanging file folder.

* * * * *